United States Patent [19]

Leurck

[11] Patent Number: 4,759,441

[45] Date of Patent: Jul. 26, 1988

[54] COMBINATION TOOL FOR USE IN HANGING WALLPAPER

[76] Inventor: William J. Leurck, 658 Oakwood Dr., Dunedin, Fla. 33528

[21] Appl. No.: 918,263

[22] Filed: Oct. 14, 1986

[51] Int. Cl.[4] ..... B65D 85/28

[52] U.S. Cl. ..... 206/373; 206/355; 206/359; 29/239

[58] Field of Search ..... 206/37, 38, 216, 349, 206/355, 357, 359, 362, 366, 372, 373; 29/239, 267, 235; 220/20

[56] References Cited

U.S. PATENT DOCUMENTS

| | | | |
|---|---|---|---|
| 1,669,399 | 5/1928 | Tronick | 206/373 |
| 1,791,586 | 2/1931 | Todd | 206/359 |
| 2,919,795 | 1/1960 | Halohan | 206/357 |
| 4,303,188 | 12/1981 | Calabrese | 206/372 |
| 4,363,433 | 12/1982 | Jaques | 206/362 |
| 4,378,624 | 4/1983 | Klingenberg | 29/239 |
| 4,386,457 | 6/1983 | Coombs | 29/235 |
| 4,395,807 | 8/1983 | Eldridge, Jr. et al. | 206/359 |
| 4,416,372 | 11/1983 | Polk | 206/372 |
| 4,466,539 | 8/1984 | Frauenhoffer | 206/359 |
| 4,478,330 | 10/1984 | Lin | 206/38 |
| 4,553,926 | 11/1985 | Crespy | 206/86 |
| 4,667,821 | 5/1987 | Shillington | 206/366 |

FOREIGN PATENT DOCUMENTS

| | | | |
|---|---|---|---|
| 385132 | 3/1965 | Switzerland | 206/373 |

*Primary Examiner*—David T. Fidei
*Attorney, Agent, or Firm*—Stanley M. Miller

[57] ABSTRACT

A combination tool having utility in connection with the hanging of wallpaper. The tool has the form of a box and includes a holder for a smoothing brush, a holder for a seam roller, a magnet for holding a utility knife, a blade holder and dispenser, a blade snapper that allows dull blade edges to be snapped off and desposited into the cavity defined by the box, a pencil sharpener and a pencil holder. Thus, the device includes all tools needed for hanging wallpaper quickly, efficiently and correctly, with the exception of staple items such as a paint roller, a level, a straight edge and a tape measure.

17 Claims, 3 Drawing Sheets

COMBINATION TOOL FOR USE IN HANGING WALLPAPER

BACKGROUND OF THE INVENTION

1. Field of the Invention

This invention relates to tools having utility in connection with hanging wallpaper, and more specifically relates to a tool that holds a smoothing brush, a seam roller, a utility knife and other items needed in hanging wallpaper.

2. Description of the Prior Art

Inventors began providing combination tools for use in wallpaper hanging jobs nearly a century ago.

A typical patent of the prior art is U.S. Pat. No. 680,586 to Hawkins (1901) and No. 812,740 to Harris and others (1906). These early devices included means for holding a smoothing brush and other items having utility in connection with wallpaper hanging.

More recent developments in the art are shown in U.S. Pat. No. 4,209,865 to Kozlowski (1980); it shows a handle member adapted to have a plurality of useful blade members releasably secured to it so that a plurality of tools can be replaced by one handle with snap-on blade implements.

The art still is not fully developed. There are no wallpaper hanging aids that can be clipped to a belt, nor are there any aids that combine virtually every tool needed for hanging paper in a single, compact tool.

Perhaps even more importantly, no device has ever been created that coul dispense blades and provide a storage means for blades in need of disposal. A common problem encountered in hanging wallpaper is dull blades; due to the high number of cuts that must be made in completing an average job, the blades employed to accomplish the cutting are quickly dulled. Dull blades rip the paper and thus require extra work.

The problem of how to supply the person hanging the paper with a ready supply of sharp blades and an easy means to dispose of the dull ones is a problem that has gone unsolved since inventors first became interested in wallpaper tools.

SUMMARY OF THE INVENTION

The present invention provides a combination tool that overcomes the limitations of the devices of the prior art.

The novel device has a box-like construction; it is hollow and its hollow interior provides a storage place for dull blades.

A plate-lined slot is provided in the top of the box. A blade having a dull cutting edge is inserted into the slot and the dull blade is snapped off by moving the body of the blade in a direction normal to the plane of the blade and the plates lining the slot, i.e., the dull portion of the blade is snapped off because it is constrained against moving by the plate it bears against when the body of the blade is bent at an angle that exceeds the flexibility limit of the blade.

The snapped off portion of the blade simply falls into the interior of the box. The removal of a pencil sharpener means allows emptying of the box whenever required.

Another important feature of the tool is its new blade dispensing means. A predetermined quantity of blades are positioned within a blade dispensing means near the bottom of the box. The dispensing means includes a bias means which presses the blades against a slot formed in the front panel of the box so that a blade can be taken from the box by engaging the same with a finger and sliding it out of an exit port formed in the side of the box; the bias means then moves another blade into position against the slot.

Other features include a magnet for holding a utility knife.

Means are also provided for holding a smoothing brush, a seam roller, and a pencil. A pencil sharpener is also provided; when a pencil is held by the pencil holder, its sharp end is resting in the sharpener.

It is the primary object of this invention to advance the art of wallpaper hanging combination tools by providing a compact, belt-carried device that incorporates all essential wallpaper hanging tools into a single unit.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
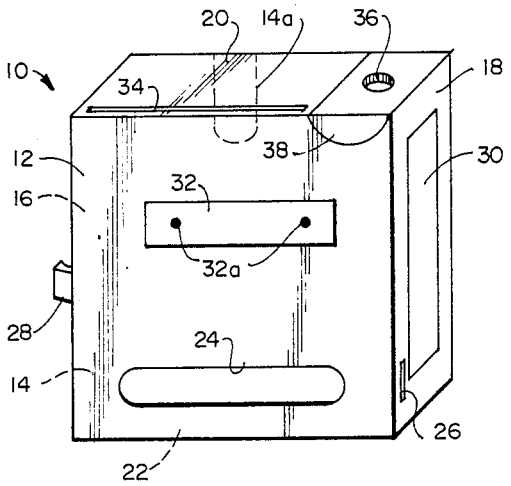
FIG. 1 is a perspective view of an illustrative embodiment of the present invention with its various holding devices empty.

Referring now to FIG. 1, it will there be seen that an illustrative embodiment of the invention is designated by the reference numeral 10 as a whole.

The unit 10 is of parallelepiped construction and includes upstanding front wall 12, back wall 14, left and right side walls 16, 18, and horizontally positioned top wall 20 and bottom wall 22.

An overview of the parts visible in FIG. 1 will be provided first; a more detailed description of the parts will then follow.

An elongate, oval in configuration slot 24 is formed in front panel 12; as will become clear as this description proceeds, slot 24 provides access into the blade dispensing means of this invention. More specifically, a blade inside box 10 may be slideably removed therefrom by the action of a finger engaging the side wall of the blade through slot 24.

The blade engaged through slot 24 exits box 10 through slot 26 formed in side wall 18. Blades are stored interiorly of the box in the holder of FIG. 6, described hereinafter, so that their sharp, cutting edges are positioned upwardly when they exit slot 26. This enables the user of device 10 to see the cutting edge as it extends out of slot 26 so that it may be safely removed.

Figure 2:
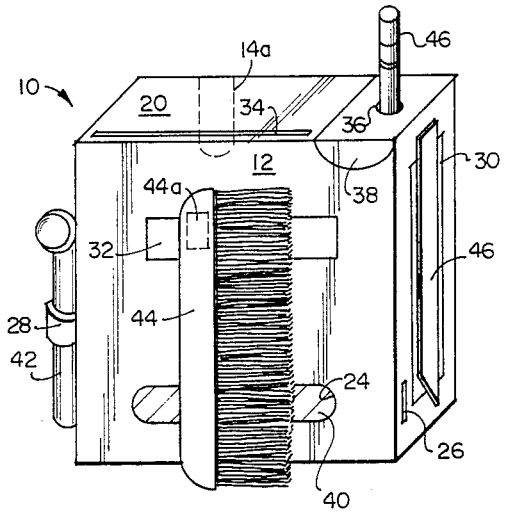
FIG. 2 is a perspective view of the device of FIG. 1 with its holding devices occupied.

A clip means 28 of PVC construction can be seen in FIG. 1; it is fixedly secured to side wall 16 and releasably secures a seam roller as will be clear from an inspection of FIG. 2.

The strip means 30 which is fixedly secured to side wall 18 is a magnet to which may be secured a metallic utility knife as shown in FIG. 2.

Figure 5:
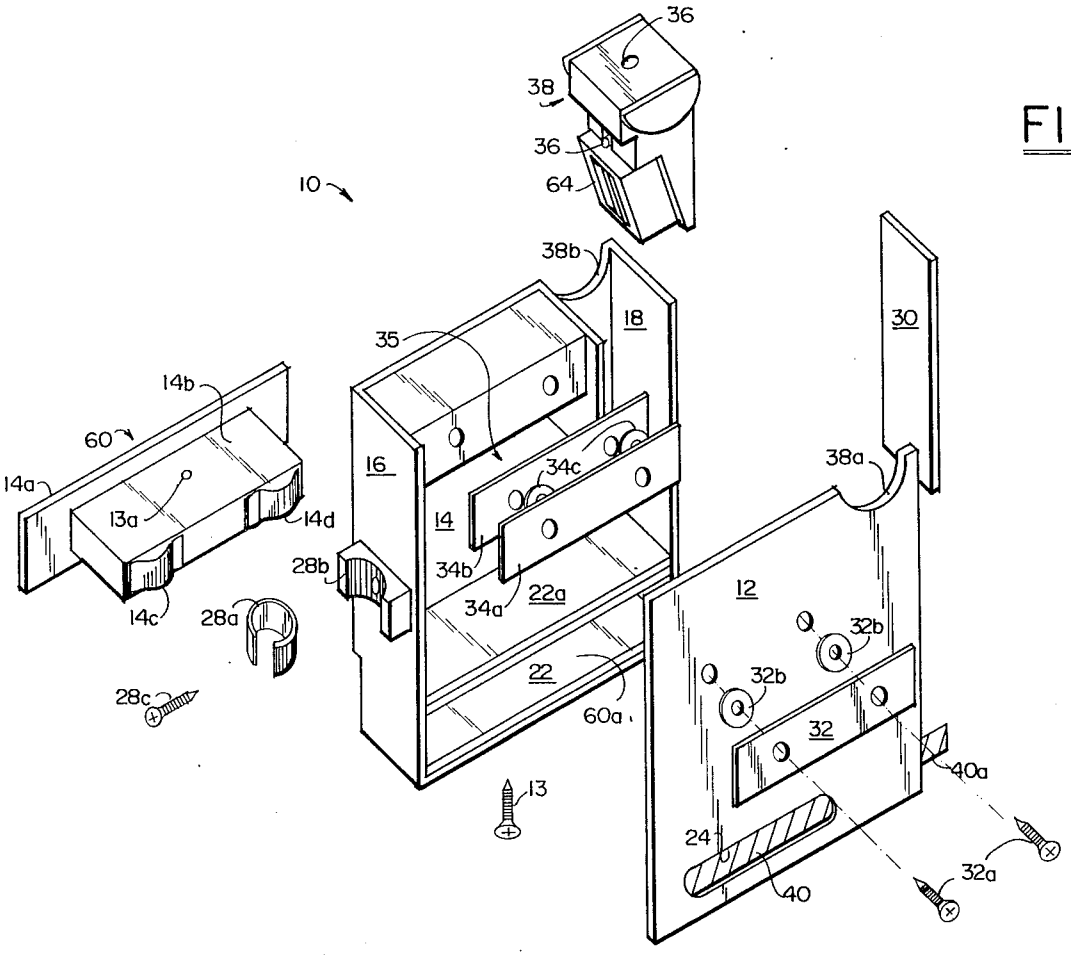
FIG. 5 is an exploded perspective view of the device showing all of its parts except the blade holding means.

Item 32 mounts the smoothing brush 44 of FIG. 2. Item 32 is a flat metal plate that is secured to front wall 12 by screw members 32*a*; it is spaced from said front wall 12 by washer members as best illustrated in FIG. 5, said washer members being collectively indicated by the reference numeral 32*b* in said FIG. 5.

A clip 44*a*, shown in phantom lines in FIG. 2, is secured to brush 44; it slides into the slot formed between metal plate 32 and box front wall 12 so that said brush 44 may hang from plate 32 in the manner depicted and may be removed from its depicted position whenever needed.

A similar clip 14*a*, shown in phantom lines in FIGS. 1 and 2, is secured to back wall 14 of box 10 so that the box may be removably mounted onto a belt. Clip 14*a* differs from clip 44*a* in that the former is resilient and normally closed so that it resiliently deforms when clipped onto a belt whereas the latter is a rigid clip member.

Slot 34 formed in top wall 20 forms a part of the blade-snapping unit more fully described hereinafter.

Bore means 36 formed in pencil holder member 38 is an upstanding bore which receives a pencil as depicted in FIG. 2.

Semicircular cut out portions 38*a*, 38*b* are formed in front and back walls 12, 14 to accomodate pencil holder member 38 as is perhaps best shown in FIG. 5. The semicircular ledges support member 38 and prevent it from simply falling down into the interior cavity of unit 10.

FIG. 5 also shows the continuation of bore 36; it should be understood that a pencil slideably received within bore 36 will have its pointed end resting in the pencil sharpener means 64. The angular position of the sharpener means 64 corresponds to the cone angle of a sharpened pencil so a pencil having its conical end resting in sharpener 64 is standing upright in bore 36.

Returning now to FIG. 2, it will there be seen that the side wall of a blade 40 is shown in said FIG. The position of blade 40 relative to access slot 24 and exit slot 26 is maintained by a biasing means disclosed hereinafter.

FIG. 2 shows the seam roller 42 held in the resilient arms of holder 28, smoothing brush 44 releasably secured to its mount 32, utility knife 46 magnetically secured to magnet 30, and a pencil 46 positioned within bore 36.

As shown in FIG. 5, holder 28 includes holding means 28*a* secured to base means 28*b* by screw 28*c*.

Figure 3:
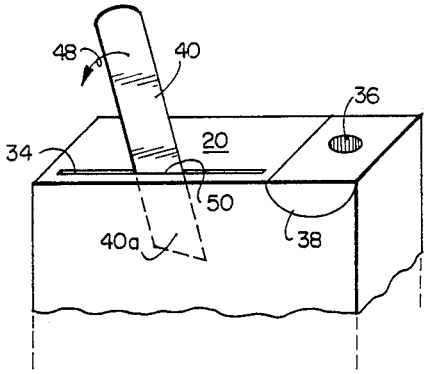
FIG. 3 is a detailed perspective view of the blade-snapping portion of the novel device.

The operation of the blade-snapping means of the present invention will be better understood in connection with FIG. 3.

FIG. 3 shows a blade 40 having a cutting edge 40*a*, dulled by repeated use, inserted into slot 34 formed in top wall 20 preparatory to breaking off said dull cutting edge.

Reference should again be made to FIG. 5 at this time; metal plates 34*a* and 34*b* are spaced apart from one another by washers 34*c* and form the sidewalls of a narrow cavity of which slot 34 is merely the entrance. Thus, portion 40*a* of knife 40 in FIG. 3 is flanked by said metal plates 34*a*, 34*b*, said plates not being shown in FIG. 3 to simplify the drawing.

Still referring to FIG. 3, it should now be clear that if blade 40 is bent in the direction indicated by arrow 48, said blade will break off at a parting line denoted 50, i.e., the person using tool 10 simply bends the blade 40 towards himself until the blade breaks off within slot 34. The broken off blade portion 40*a* will drop into the inside of the box where it can safely remain until the box fills up and emptying thereof is required.

More specifically, the broken off blade will fall atop false bottom wall 22*a*, shown in FIG. 5. It can be removed whenever desired by lifting pencil holder member 38.

Figure 4:
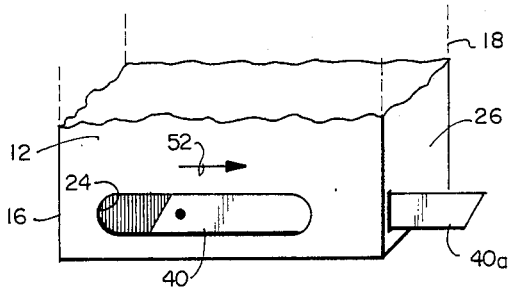
FIG. 4 is a front elevational view of the blade-dispensing portion of the device.

The operation of the blade dispensing means is best shown in FIG. 4. A finger or thumb is placed against the side wall of blade 40 through acces slot 24, and the blade is slid to the right as indicated by directional arrow 52 until its cutting edge 40*a* exits slot 26. The blade can then be grasped and pulled out of its holder.

Figure 6:
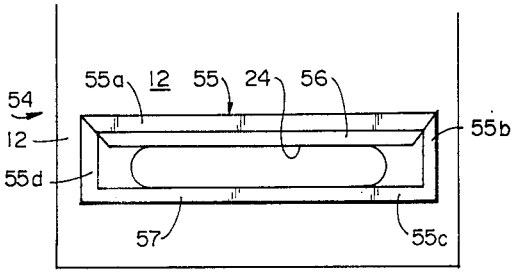
FIG. 6 is a rear elevational view of the blade holding means.

The blade holder 54 is best shown in FIG. 6. It is preferably of metallic construction but may be formed of plastic or other suitable material.

Blade holder 54 includes a rectangular frame portion 55 which includes portions 55*a*, 55*b*, 55*c* and 55*d* as depicted. A flange member 56 is integrally formed with frame portion 55*a* and is bent with respect thereto so that said flange 56 is spaced apart from the inside surface of front wall 12 as shown; similarly, a flange 57 formed integrally with frame portion 55*c* is bent with respect to frame portion 55*c* so that it is also spaced apart from the inside surface of front wall 12.

A small chamber is thus defined by flange members 56, 57 and a quantity (preferably five) of blades 40 may be slidingly introduced thereinto when back wall 14*a* (disclosed and described hereinafter) is removed from the Hanger's Helper (TM) 10.

Referring again to FIG. 5, the biasing means that urges blades 40 toward front wall 12 can be seen in detail; it is designated by the reference numeral 60 as a whole.

Biasing means 60 includes a back wall 14*a* denoted as such since it lies flush with back wall 14 when unit 10 is assembled, there being a cut out portion formed in back wall 14 to accommodate section 14*a* and to permit said back wall section 14*a* to be removed independently of back wall 14.

A box-like structure denoted generally as 14*b* is fixedly secured to back wall removable section 14*a* and extends therefrom in a horizontal plane as shown. Box portion 14*b* provides a mounting means for two bias members 14*c*, 14*d*, said bias members being leaf springs which protrude outwardly of openings formed in the box 14*b* as is clearly shown.

Springs 14*c*, 14*d* bear against the side walls of the blades positioned in the blade holder of FIG. 6. Thus, as the outermost of the blades 40 is slid from blade holder 55 by a finger gaining access thereto through slot 24, springs 14*c*, 14*d* urge the next blade in the stack of blades to take its place.

Aperture 13*a* in blade biasing means 60 should be noted. It represents a bore that extends vertically through member 60 all the way to and through bottom wall 22 of unit 10. Accordingly, removal of screw 13 from bore 13*a* allows unit 60 to be separated from box 10 to allow re-charging of blades into blade holder 55.

It will be observed from an inspection of FIG. 5 that an interior, horizontally disposed wall 22*a* is vertically spaced upwardly of bottom wall 22, and that a cavity 60*a* is defined therebetween. The box portion 14*b* of biasing means 60 is slideably received within cavity 60*a* when unit 10 is fully assembled. Thus, broken blades fall into cavity 35 below slot 34, but said blades fall onto interior bottom wall 22*a* which wall 22*a* prevents said broken blades from interfering with the removal of biasing means 60 as needed from time to time, i.e., wall 22*a* represents a false bottom so that removal of unit 60 to re-charge blade holder 55 does not necessitate removal of broken blades.

When it is desired to remove broken blades from cavity 35, the pencil holding and sharpening unit 38 is simply lifted out of its position.

Shavings fall from sharpener 64 into cavity 35 whenever the sharpener is used and are thus removable whenever broken blades are removed.

The provision by the Hanger's Helper (TM) of a high number of operative parts that cooperate to form a highly versatile yet compact unit represents an important advance in the art of tools having utility in the wallpaper hanging industry.

Amateurs and professionals alike will find that it makes hanging wallpaper easier; by combining so many functions, it saves the time that would otherwise be lost looking for needed tools, replacing blades, and so on.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A combination tool having utility in applications where wallpaper is to be applied to a surface, comprising:

a box member having a substantially hollow interior;

said box member including an upstanding front panel, a back panel, left and right side walls, and a top and bottom wall;

a slot formed in said top wall;

a pair of fixedly mounted, closely spaced, vertically aligned plate members positioned downwardly of said slot;

said plate members being spaced apart a distance slightly greater than the thickness of a knife blade so that a knife blade inserted into said slot and thereby positioned between said plate members can be broken when bent sufficiently;

said hollow interior of said box member providing a receptacle for the broken off portions of blades inserted into said slot and broken;

an elongate, horizontally disposed opening formed in said front panel;

a blade holder positioned rearwardly of said opening, in abutting relation to an inside surface of said front panel;

a plurality of blades positioned within said blade holder so that a side of an outermost blade is accessible through said opening;

a bias means for urging said blades within said blade holder into abutting relation with said opening, said blade members having a size greater than the size of said opening;

an exit slot formed in a side wall of said box so that a blade can be removed from said blade holder by sliding it through said exit slot upon engaging it through said opening;

a false bottom formed interiorly of said box so that blades snapped off by said plate members accumulate atop said false bottom and not atop the inside surface of the bottom wall of said box;

a cavity formed between said false bottom and the bottom wall of said box;

said bias means being specifically configured and dimensioned to occupy said cavity.

2. The tool of claim 1, wherein said back panel has a cut out portion corresponding in size and shape to a rear wall of said bias means so that said bias means lies flush to said back panel of said box member when the tool is assembled.

3. The tool of claim 2, wherein said bias means and said box member are releasably secured to one another so that removal of said bias means grants access to said blade holder.

4. The tool of claim 3, further comprising:

a closure member that grants access into the interior of said box member upon removal so that snapped off blades accumulating therewithin may be removed;

said closure member provided in the form of a pencil holder and pencil sharpener which are removably seated with respect to said box member so that removal of said pencil holder and sharpener opens the interior of said box member.

5. The tool of claim 4, further comprising a magnet member fixedly secured to a side wall of said box member so that a metallic blade may be releasably retained thereby.

6. The tool of claim 5, further comprising a clip member that releasably interconnects said box member to a belt worn by an individual using said tool.

7. The tool of claim 6, further comprising a mounting member for releasably holding a seam roller, said roller mounting member being fixedly secured to a side wall of said box member.

8. The tool of claim 7, further comprising a brush mounting member for releasably holding a smoothing brush, said brush mounting member being a flat plate fixedly secured to the front panel of said box member but spaced apart therefrom to receive a clip secured to said smoothing brush.

9. A combination tool having utility in connection with wallpaper hanging, comprising:

a hollow box member;

a box closure means which when opened grants access into the interior of said box member;

said box closure means provided in the form of a pencil holder and pencil sharpener member so that shavings generated by sharpening a pencil in said sharpener member are accumulated in the hollow interior of said box member;

whereby removal of said closure means allows removal of said shavings from said box interior;

a false bottom formed in said box member;

a cavity formed in said box member downwardly of said false bottom;

a blade holder member positioned within said cavity;

at least one blade member slideably disposed within said blade holder member;

a bias means for urging a blade in said blade holder member toward a front panel of said box member;

said bias means positioned within said cavity;

a first slot formed in a panel of said box member to expose a side of a blade member held in said blade holder member;

and a second slot formed in a side panel of said box member so that a blade member held in said blade holder member can be slideably removed therefrom by sliding it through said second slot by engaging it with a finger through said first slot.

10. The tool of claim 9, further comprising:

a blade breaking means provided as a part of said box member;

said blade breaking means including a pair of spaced flat plate members mounted interiorly of said box member adjacent a top panel thereof;

a slot means formed in a top panel of said box member contiguous to said flat plate members so that a blade member inserted into said slot means and bent laterally will break at a breaking line contiguous to a top panel of said box member;

whereby a broken blade member falling into the hollow interior of said box member may be removed therefrom attendant removal of said box closure means.

11. A combination tool, comprising:

a hollow box member;

a false bottom member positioned within said box member to divide the interior of said box member into a major cavity above said bottom wall member and a minor cavity below it;

a closure means operative to close said major cavity;

said closure member provided in the form of a pencil holding and sharpening member that is removably mounted with respect to panels that form said box member;

and a bias means that substantially occupies all of said minor cavity.

12. The tool of claim 11, further comprising:

a blade breaking means positioned within said major cavity;

an access opening to said blade breaking means formed in said box member;

whereby blades to be broken are inserted into said blade breaking means through said access opening and whereby broken blades are accumulated in said major cavity.

13. The tool of claim 12, further comprising:

a blade holder member positioned in said minor cavity;

a plurality of blade members slideably held by said blade holder member;

and said bias means operative to urge against the blades in said blade holder member.

14. The tool of claim 13, further comprising:

a first elongate slot formed in a front panel of said box member contiguous to said minor cavity;

a second slot formed in a side panel of said box member, contiguous to said minor cavity;

whereby blade members are removed from said minor cavity through said second slot by engaging said blade members with a finger through said first slot.

15. The tool of claim 14, further comprising a magnet fixedly secured to a panel of said box member for releasably retaining a knife member.

16. The tool of claim 15, further comprising a seam roller holder member fixedly secured to a panel of said box member.

17. The tool of claim 16, further comprising a mounting member secured to a panel of said box member to which a smoothing brush may be releasably attached.

* * * * *